US007090429B1

(12) United States Patent
Humphrey et al.

(10) Patent No.: US 7,090,429 B1
(45) Date of Patent: Aug. 15, 2006

(54) HIGHWAY DELINEATION UNIT AND METHOD OF INSTALLING SAME

(76) Inventors: William D. Humphrey, 101 N. 48th Ave., Unit 25B, Yakima, WA (US) 98908; Vernon Larson, 1621 Pleasant Hill Rd., Selah, WA (US) 98942

( * ) Notice: Subject to any disclaimer, the term of this patent is extended or adjusted under 35 U.S.C. 154(b) by 0 days.

(21) Appl. No.: 11/198,494

(22) Filed: Aug. 5, 2005

(51) Int. Cl.
*E01F 9/00* (2006.01)

(52) U.S. Cl. ..... 404/9; 116/63 R; 404/10

(58) Field of Classification Search ..... 404/9, 404/10; 40/608, 612; 116/63 R; D21/126
See application file for complete search history.

(56) References Cited

U.S. PATENT DOCUMENTS 3,775,924 A * 12/1973 McClure, Jr. ..... 52/155
4,084,914 A 4/1978 Humphrey et al.
4,245,922 A 1/1981 Auriemma
4,298,075 A * 11/1981 Sweeney ..... 173/129
4,298,292 A 11/1981 Sweeney
4,343,567 A 8/1982 Sarver et al.
4,435,107 A 3/1984 Sweeney
4,522,530 A 6/1985 Arthur
RE32,045 E 12/1985 Schmanski
4,564,309 A 1/1986 Bjorlund
4,621,940 A 11/1986 Anderson
5,028,166 A * 7/1991 Leishman ..... 404/10
D337,129 S 7/1993 Sandy ..... D20/10
5,620,277 A 4/1997 Cole
5,689,918 A * 11/1997 Johnson ..... 52/153
5,794,910 A * 8/1998 Granger ..... 248/548
6,375,385 B1 4/2002 Kennedy

* cited by examiner

*Primary Examiner*—Gary S. Hartmann
(74) *Attorney, Agent, or Firm*—Jensen & Puntigam PS

(57) ABSTRACT

A highway delineation marker fabricated of two thin, resilient, elongated panels, U-shaped in cross section, secured together open-face to open-face, capturing a foam core. The lower end of the rear panel is captured behind a tab on the front panel for ease of insertion and the front panel includes two or more outwardly projecting tabs for interaction with a mating insertion tool for placement of the delineator marker into a pilot hole.

1 Claim, 3 Drawing Sheets

HIGHWAY DELINEATION UNIT AND METHOD OF INSTALLING SAME

TECHNICAL FIELD

A traffic delineation device is desirable upon many highways to indicate to the driver the edge of the road or, in the alternative, an upcoming division or revision in traffic lanes.

In a design of such marking posts or traffic delineators it is desirable for the post to be constructed in a manner which is inexpensive and provides for a quick and simple installation. The post should also be able to withstand many impacts from the bumpers of high speed vehicles without sustaining damage or destroying the post and/or without pulling the post out of the ground. The ease and speed of installation is particularly important in view of the large number of parking posts or traffic delineators which are used along the highways and expressways and, in fact, frequently the installation of the posts is performed when the installer is exposed to motor vehicle traffic.

For the same reasons, it is also desirable for the post to be designed for quick and conventional replacement in the event it is destroyed or no longer usable.

Further, the post must be installed in a manner by which the post may not be easily damaged or removed by persons walking along the roadway and/or during the installation process.

In general, the marking post would also carry reflective material not easily removed from the post.

BACKGROUND OF THE INVENTION

Prior art known to the present inventor includes:

U.S. Pat. No. 4,084,914, granted Apr. 18, 1978 to Humphrey et al, which discloses a self-erecting highway guide post, which comprises a pair of arcuate channel members which are secured together to form a hollow element and may include integrally constructed barbs or holes to resist removal of the channel once inserted.

U.S. Pat. No. 4,298,292, granted Nov. 3, 1981 to Sweeney, which discloses a flexible delineator member and anchor disposed in a rigid pilot plate such that when the anchor and pilot plate are driven into the ground or road surface, the bottom end of the delineator follows the bottom edge of the pilot plate.

U.S. Pat. No. 4,522,530, granted Jun. 11, 1985 to Arthur, which discloses a traffic delineator wherein the lower end portion of the tube includes outwardly projecting spring fingers which positively lock the device into the ground.

U.S. Pat. No. Re. 32,045, granted to Schmanski Dec. 10, 1985, discloses a fiber glass reinforced plastic post, including vertical rigid ribs to assist in driving the post into position.

U.S. Patent No. Des. 337,129, granted Jul. 6, 1993 to Sandy, which discloses a sign mounted upon what appears to be a synthetic post.

U.S. Pat. No. 5,620,277, granted Apr. 15, 1997 to Cole, Sr. et al, which discloses a marking device, including at the lower end a slot for receiving an anchoring device, including outwardly flared fingers.

U.S. Pat. No. 6,375,385 B1, granted Apr. 23, 2002 to Kennedy, which discloses a laminated flexible support, including a plurality of individual members, the flexibility being adjusted by tension members placed along the length of the laminated element.

DISCLOSURE OF THE INVENTION

The present invention is directed to an improved, self-erecting roadway marking device post which provides all of the desirable features and advantages mentioned above and is also adapted for economical construction.

In accordance with one embodiment of the invention, these advantages are provided by marking posts or traffic delineators which include a pair of thin, resilient, elongated channel elements (0.080 to 0.095 inches thick) which are sandwiched together to form a tube-like structure which may include a stiffening foam insert. Each of the channel members is tapered at its lower portion to allow easy insert, as well as simplify the construction. In the preferred embodiment, one of the aforementioned channel members is longer than the other and includes at its lower end two or more outwardly extending tabs to receive a driver member as explained hereinafter and one inwardly extending tab member to receive and capture the lower end of the second channel member. During the insertion process, a hole to receive the traffic marker or delineator is prepared by utilizing a rigid spade member, which includes an upwardly extending shaft and a driver platform, such that a slider hammer may be reciprocated on the shaft, driving the spade into the supporting ground, providing a pilot hole. Following the preparation of the pilot hole, a post inserter having a pair of forwardly extending tabs, which mate with the outwardly extending tabs of the first channel member is mated with the traffic delineator, the post-inserter likewise includes a reciprocal hammer member mounted to the handle such that the post inserter and attached post can be driven into the pilot hole. It is to be understood that the post inserter includes a rigid downwardly extending portion which extends to approximately the lower portion of the delineator post, thus allowing the post to be pulled into the pilot hole, rather than driven into the pilot hole such that the damage to the post is minimized or eliminated.

BEST MODE FOR CARRYING OUT THE INVENTION

Figure 1:
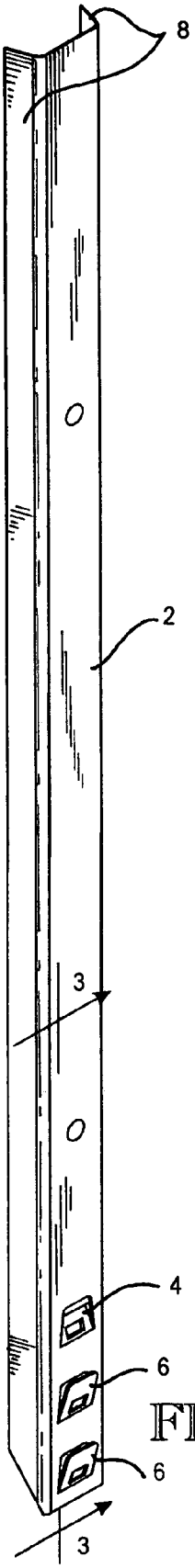
FIG. 1 discloses an isometric view of the inventive traffic delineator device.

As seen in FIG. 1, the traffic delineator is an elongated element designed to be inserted into the ground in a vertical position such that the main body portion 2 extends upwardly and would normally include a reflective mechanism along its entire front face or at least at the upper portion thereof. As seen in this view, the mechanism includes in its front face a plurality of outwardly displaced tab members 4,6, wherein 4 are displaced rearwardly and 6 is displaced forwardly or outwardly of the main face 2. Further to be seen in this view is the fact that the face 2 includes 2 rearwardly projecting wings or rearwardly placed walls 8.

Figure 2:
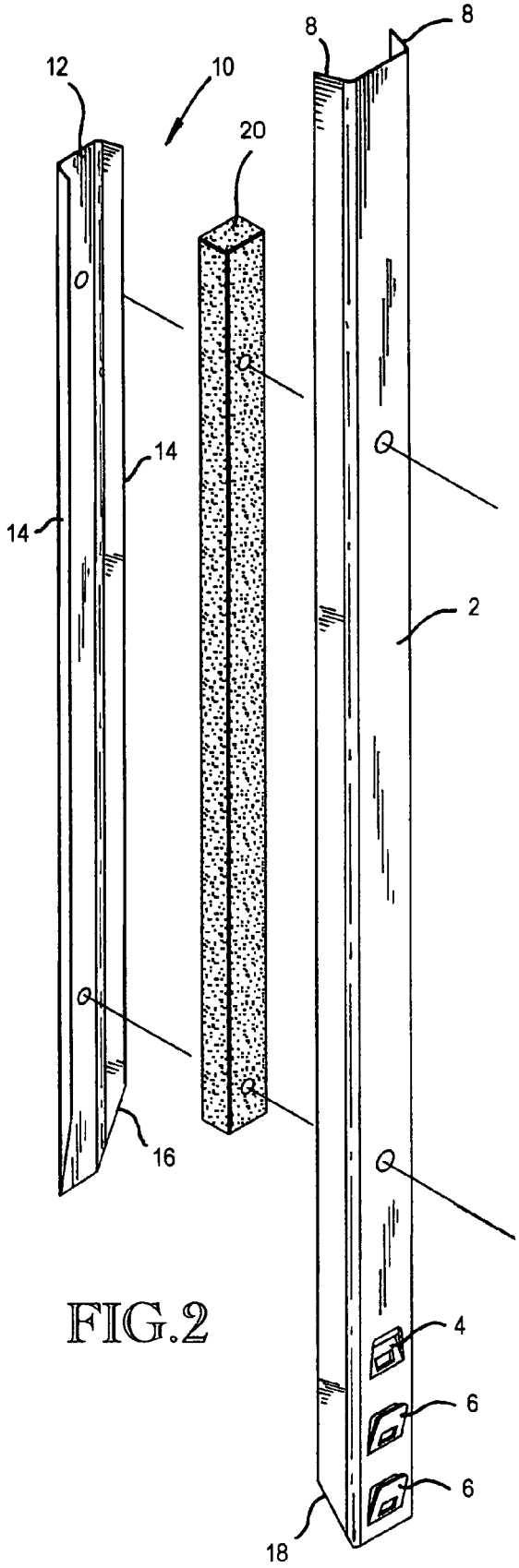
FIG. 2 is an exploded view of the device of FIG. 1.

Referring now to FIG. 2, it can be seen that the main element 2 as described hereinabove is designed to be mated with a rear element 10 which likewise is U-shaped in cross section, although not a smooth curve, having a rear face contiguous with the forwardly projecting wing elements 14. It is to be noted that the lower portion of both elements 2 and 12 are tapered as at 16, 18 to accommodate the insertion of the device into the ground as explained hereinafter. Likewise shown in this view is an intermediate rigid foam element 20 which is secured when assembled between the elements 2 and 12, reducing the amount of twist which occurs in a heavy wind as well reducing the overall sound generated thereby.

Figure 3:
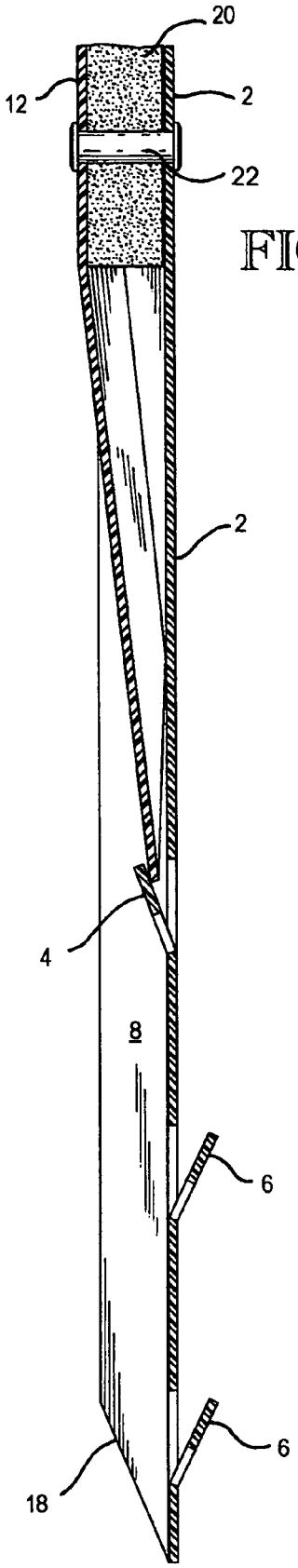
FIG. 3 is an enlarged view taken along lines 3—3 of FIG. 1, illustrating the construction of the element of FIG. 1.

Reference is now had to FIG. 3, which is taken along lines 3—3 of FIG. 1 which shows the lower portion of element 2 and 12, demonstrates the securement of 2 and 12 by means of a rivet 22 which passes through and secures element 20. Likewise seen in this view are the interaction between rearwardly displaced tab member 4 and the lower portion of element 10 locking the lower portion of the element in position.

Figure 4:
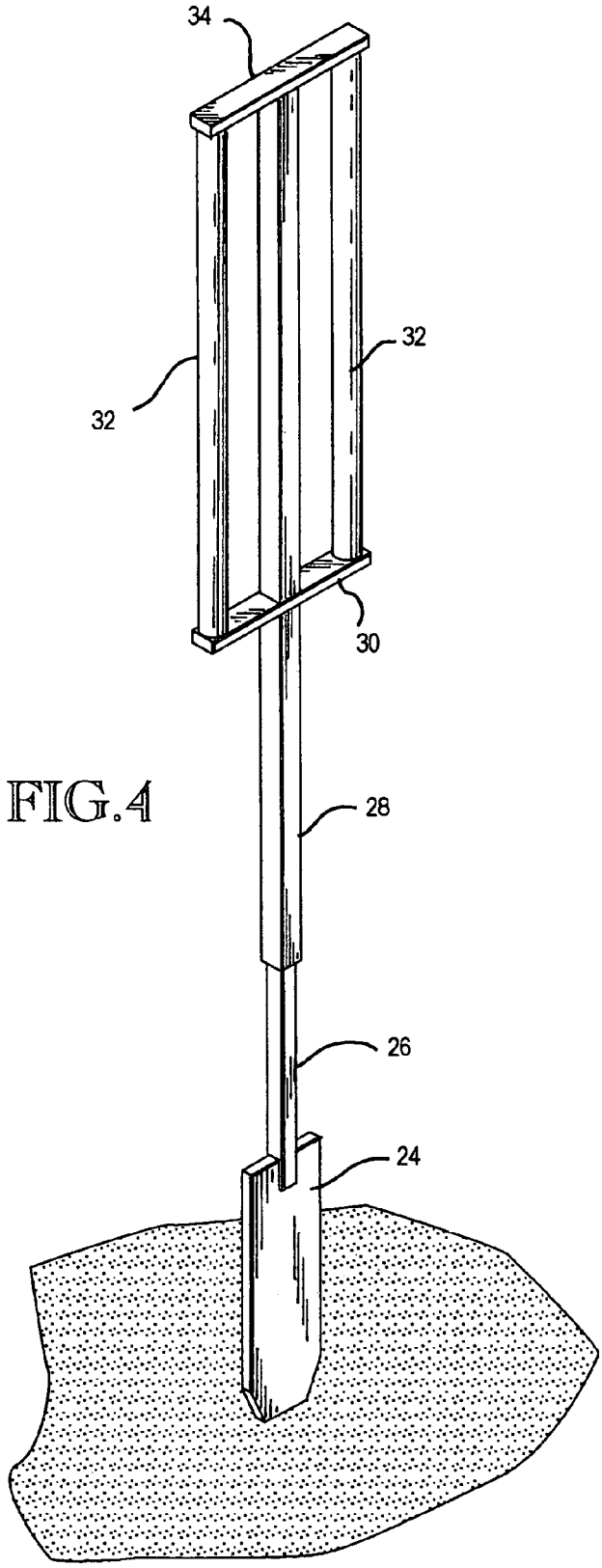
FIG. 4 is an isometric view of the pre-boring spade.

Reference is now had to FIG. 4, wherein is shown a rigid spade member 4 secured to a rigid rectangular shaft 26 and a mating tubular shaft 28 which has at its upper portion a handle member including a lower horizontal element 30, a pair of parallel side elements 32 and a rigid horizontal upper element 34. It is to be understood that when the upper element, including elements 28–34, is reciprocated along shaft 26 it drives spade 24 into the soil, preparing a pilot hole to receive the traffic delineator member as seen in FIG. 1.

Figure 5:
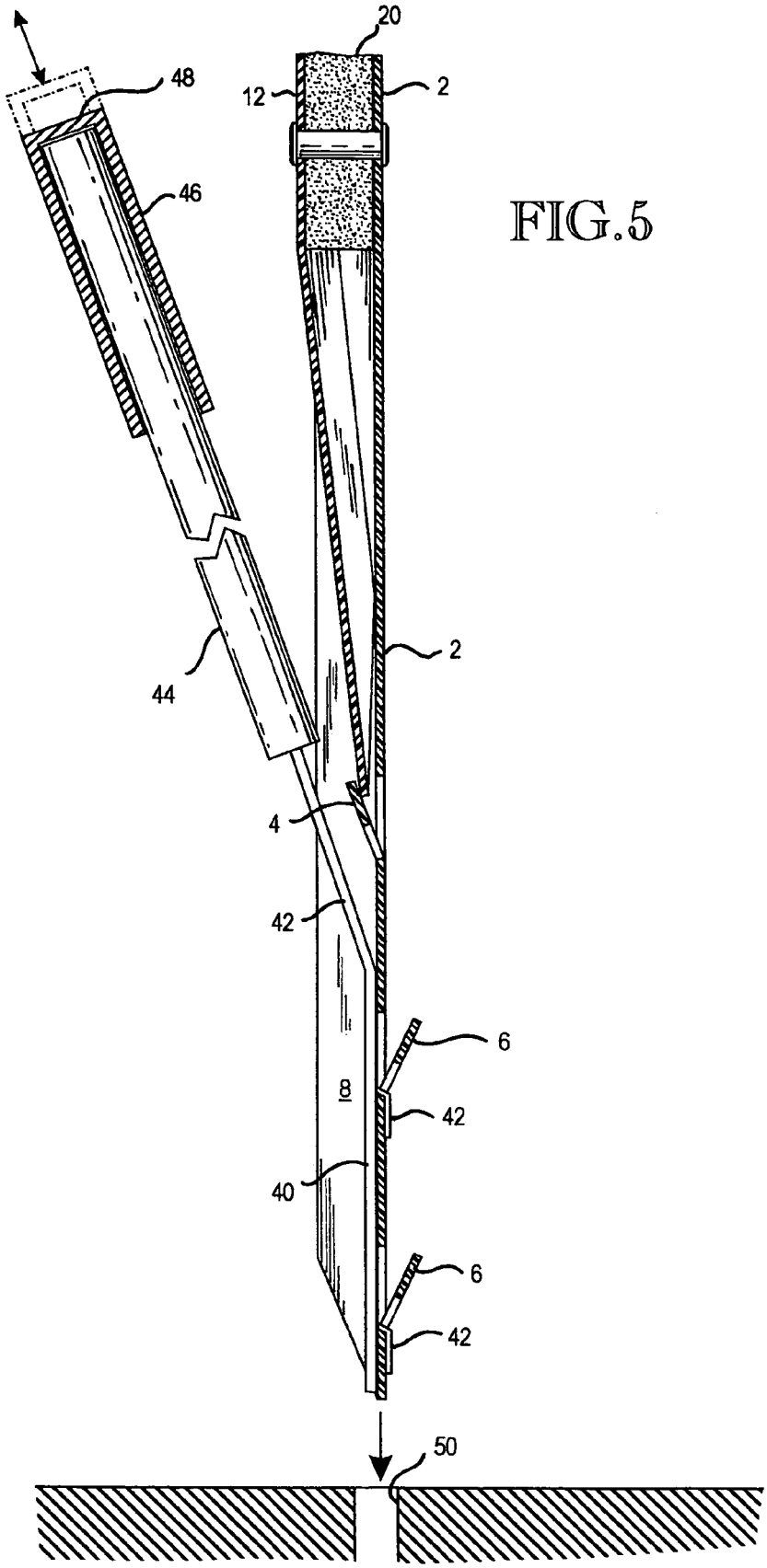
FIG. 5 is an elevational view of the driver mechanism is place for inserting the traffic delineator in the pre-bored hole.

Reference is now had to FIG. 5, wherein the lower portion of the traffic delineator, as depicted in FIG. 3, also includes the insertion or drive mechanism which includes a lower foot member 40, having outwardly extending latch members 42 which interact with apertures in tab member 6 locking the foot member to the outside of element 2. Foot 40 extends upwardly through an angular extension 42 to terminate into an elongated shaft element 44 which has mounted thereon an axially slidable sleeve 46 such that when the sleeve 46 is reciprocated, the cap 48 abuts the upper end of shaft 44 causing the insertion tool to drive the delineation element into the pre-bored hole 50.

It is contemplated that the inventive device will be sold as a unit wherein there will two or more traffic delineators accompanied by a pilot hole bore element and an inserting element, such that the traffic delineator elements may be sequentially placed utilizing the same tools.

Thus as can be seen, the present invention provides a method and apparatus for inserting a traffic delineator wherein the traffic delineator itself is fabricated of the material which will respond to the upright position following an impact with a vehicle or the like and yet the apparatus for insertion of the device assures that it will be properly placed beneath the surface of the ground, and further, will not be damaged during the insertion process.

The invention claimed is:

1. A highway delineation marker which self erects if struck by a vehicle, comprising:

a first front member fabricated of a thin resilient material having a substantially flat elongated front panel integral with a pair of opposing rearwardly extending side elements, said front panel including a first bottom end including linearly spaced frontwardly projecting tab elements permitting engagement with a separate driving tool during insertion of the marker and a rearwardly projecting tab linearly spaced further from the bottom end, said side elements tapering toward the front at the bottom thereof;

a second elongated rear member fabricated of a thin flexible material including a substantially flat rear panel and opposing forwardly extending side elements, said rear element being shorter than the front element and including a frontwardly tapered lower end locked behind the rearwardly projecting tab of the front member;

foam substantially filling the space between the front member and the rear member; and means for fastening the front member to the rear member, whereby an integral unit is formed which is designed for placing the bottom end of the marker into the ground.

* * * * *